US011445862B2

(12) United States Patent
Schlabach

(10) Patent No.: US 11,445,862 B2
(45) Date of Patent: Sep. 20, 2022

(54) GRAB BAR ASSEMBLY FOR SHOWER AND BATHTUBS

(71) Applicant: Wayne Schlabach, Mount Eaton, OH (US)

(72) Inventor: Wayne Schlabach, Mount Eaton, OH (US)

( * ) Notice: Subject to any disclaimer, the term of this patent is extended or adjusted under 35 U.S.C. 154(b) by 64 days.

(21) Appl. No.: 16/927,153

(22) Filed: Jul. 13, 2020

(65) Prior Publication Data

US 2021/0259477 A1 Aug. 26, 2021

Related U.S. Application Data

(60) Provisional application No. 62/995,899, filed on Feb. 20, 2020.

(51) Int. Cl.
*A47K 3/00* (2006.01)

(52) U.S. Cl.
CPC ..... *A47K 3/003* (2013.01)

(58) Field of Classification Search
CPC ..... A47K 3/003
USPC ..... 4/559, 576.1, 577.1, 605, 611
See application file for complete search history.

(56) References Cited

U.S. PATENT DOCUMENTS 3,028,604 A * 4/1962 Warner ..... A47K 3/003 4/576.1
8,104,726 B2 * 1/2012 Hoernig ..... A47K 17/022 4/559
2008/0237426 A1 * 10/2008 Walters ..... H04N 5/64 248/316.8
2016/0166118 A1 * 6/2016 McDonald ..... A47K 3/003 4/611

* cited by examiner

*Primary Examiner* — Tuan N Nguyen
(74) *Attorney, Agent, or Firm* — Brennan, Manna & Diamond, LLC

(57) ABSTRACT

This present invention discloses an easy to install and repositionable grab bar assembly that provides support for users while using a shower, bathtub, spa or the like. The grab bar assembly is comprised of a grab bar, a back plate with slots and anchoring elements to secure the assembly to a wall surface. The grab bar assembly is attached to the wall surface by placing the backplate against the wall surface so as to align the slots to pre-drilled holes in the wall surface. The anchoring elements and other securing components are then tightened to secure the grab bar assembly to the wall. The slot-based design enables an individual to slide the grab bar as required by the user.

20 Claims, 6 Drawing Sheets

GRAB BAR ASSEMBLY FOR SHOWER AND BATHTUBS

CROSS-REFERENCE TO RELATED APPLICATION

The present application claims priority to, and the benefit of, U.S. Provisional Application No. 62/995,899, which was filed on Feb. 20, 2020 and is incorporated herein by reference in its entirety.

BACKGROUND

The present invention relates generally to the field of home bathroom improvement accessories such as grab bars. More specifically, the present invention relates to a slidable or movable grab bar assembly for showers, bathtubs, or other enclosures such as a soaking or therapeutic tub, etc. which is easily and quickly installed without the need for any precise screw placement requirements. Accordingly, the present specification makes specific reference to the presently described invention and it is to be appreciated that aspects of the present invention are also equally applicable to other like applications, devices, accessories and methods of manufacture.

By way of background, many severe accidents often occur in a bathroom of residential homes, hotels, care facilities or public restrooms. Typically, the reason that such accidents occur is that many bathroom items, such as bathtubs, toilets, showers and floors, are made out of a smooth solid material, such as porcelain, tile, marble, fiberglass, and metal. Slippery surfaces can also be caused by the presence of detergent or soap concentration on the surface or on a user's foot or sole surface, bacteria, algae, and the like. Also, such materials have a tendency of becoming extremely slippery when wet, which poses a dangerous threat to users, such as the risk of physical injury caused by the user slipping and falling.

Usually, the presence of any amount of water on the floor in a bathroom can create a slick surface and further increase the chances of a user falling down while taking shower, entering a bathtub and/or coming out from the bathtub, spa or therapy tub. In such scenarios, users are injured and can suffer a number of injuries including, but not limited to, slight bruises or abrasions, sprains, swollen joints, head injuries, broken bones and even death. The injuries can occur to individuals of any age from young children to elderly people and the injuries are often caused by slipping or simply losing balance due to the slippery nature of the floor or tub or shower enclosure. Unfortunately, elderly people are far more likely to fall in the bathtub or shower enclosure than are young people and are far more susceptible to more serious injury. Elderly people can be more prone to fall during a shower or getting in or out of a bathtub, as they may have weaker muscles, arthritic or other medical conditions making it more difficult to grab and firmly hold on to a support surface to allow their safe movement. Therefore, a method and device to provide stability or a supporting assembly for a user while accessing a bathroom, bathtub, taking a shower, and the like is desired.

In an attempt to lower the risk of injury in the bathroom and aid users, including those with or without disabilities, an assortment of grab bars or grab rails have become generally available and widespread in bathroom facilities. Usually, a grip bar or a towel holder is installed in bathrooms that provides an assembly fixedly attached at a predetermined height position of a wall surface in a vicinity of a door to hang towels or other bathing accessories. An individual may hold the grip bar with a hand when entering or exiting a bathtub in the bathroom. However, the bather may not utilize the grip bar for standing up in the bathtub, as the grip bar is fixed at a predetermined height, which is difficult to reach when the bather is using the bathtub. Furthermore, such towel holders or grip bars are usually attached to the wall surface near the door and is normally away from the shower assembly. In such a case, the bather is using a shower, and needs a support to grab to prevent inadvertent falls and injuries, such existing grip bar or towel holder fails to serve the purpose. Therefore, a convenient assembly providing a support handle for bather while using shower is required.

Some grab bars or handrails, which are a support device that a user holds on to for stability, can be attached to walls, ceilings and bathtubs to help people stabilize themselves in areas with a high fall risk, like bathrooms or staircases. Grab bars are generally installed near a bathtub or a shower wall to provide support while entering a bathtub, exiting from a tub and to aid the shower user in maintaining balance while in the tub or shower. Such grab bars conventionally have a metal tube for handling, that extends through the wall in the installation area. This configuration provides complications for people with small or frail hands who cannot grab the hand rail securely, and thus the hand rail becomes useless for such individuals and the danger of serious injury remains ever present. Existing grab bars have a fixed position on the wall and can require a completely new installation in case the grab bar needs to be shifted or moved that causes inconvenience and decreases the aesthetic value of the wall due to multiple redundant drill holes and the appearance of a series of patches. Further, the grab bar assembly, used conventionally, can be expensive and time-consuming to assemble, and is subject to failure during the use, such as when a user inadvertently pulls the fixture out of the wall when trying to prevent themselves from falling. Sometimes, it may also be necessary to seek assistance or help from an expert to properly install the grab bar assembly.

Furthermore, the installation of the existing grab bars requires an expert or a user to drill holes at specific positions of a wall surface based on handle structure and screw assembly requirements. Precise placement of the screws at the particular drilled positions is needed otherwise the grab bar will not be able to be installed, thereby requiring additional holes to be made within the wall. The need for precise screw placement is often difficult and time-consuming for experts and users, and sometimes the user even fail to properly install the grab bars due to precise screw placement requirements which can result in the grab bar unintentionally being pulled off the wall or installation location, leading to damage of the structure and possible injury to the user.

Therefore, there exists a long felt need in the art to provide users with a grip bar assembly that can be utilized by an individual in a shower, bathtub, spa or other therapeutic tub. There is a long felt need in the art for a grab bar or a handle assembly that is easily installable and which saves installation time and is hassle-free. There is also a long felt need in the art to provide a grab bar assembly which can be easily installed by a homeowner or resident without an external expert support technician. Additionally, there is a long felt need in the art for a grab bar assembly which is inexpensive yet effective in providing support to the users and increasing safety of the facility. Finally, there is a long felt need in the art for a grab bar which can be installed without precise screw placement requirements and can be readily adapted to accommodate a plurality of users based on the position or size of the user relative to the wall for a tub, spa and shower.

The subject matter disclosed and claimed herein, in one embodiment comprises an easy to install stability grab bar product for showers, spas, and bathtubs including their specific enclosures. The stability grab bar product of the present invention has an anti-slip knurled grab bar, a slotted back plate of the bar assembly, a plurality of wall anchoring elements, nuts and washers. To install the stability grab bar on a wall surface, a user drills holes in a wall surface based on the slot's dimensions of the back plate. The user places the bar horizontally over the drilled holes such that the slots in the stability bar aligns with the drilled holes. The user, then, fixes the bar by inserting the anchoring elements into the drilled holes and securing the bar assembly by tightening each of the screws inserted into the holes. In the most preferred embodiment, the stability bar has four slots and four anchoring elements, one for each slot. The slots of the grab bar of the present invention provides a slidable handle assembly, which is easily accessible by a variety of users as well as any user as they move about the bathing enclosure. The slots in the back plate allow the user to change the position of the stability bar independent of the drilled holes as the bar slides or moves along with the back-plate slots securely and without separating from the wall. The invention also offers a more convenient and hassle-free installation of the grab bars for the users with no need of a precise drill placement since a user can slide the grip bar product as desired and needed.

In this manner, the grab bar assembly of the present invention accomplishes all of the forgoing objectives, and provides a relatively quick and easy to install grab bar assembly to address the safety concerns of the user. The grab bar assembly of the present invention can be easily installed without an external expert support at home. Additionally, grab bar assembly is inexpensive yet effective in providing support to the users. Finally, the grab bar assembly of the present invention provides users with a grab bar which can be installed without any precise screw placement requirement and saves installation time when compared with conventional grab bar assemblies.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises an easy to install stability grab bar product for showers and bathtubs. The stability grab bar product comprises an anti-slip knurled grab bar, having a griping pattern, a slotted back plate of the bar, wall anchoring elements, nuts and washers. To install the stability grab bar on a wall surface, a user drills holes in a wall surface based on the slot distance of the back plate. The user places the bar horizontally over the drilled holes such that the slots in the stability bar aligns with the drilled holes. The user, then, fixes the bar by inserting the anchoring elements into the drilled holes and securing the bar assembly by tightening the screws.

In the most preferred embodiment, the stability grab bar has four slots on a back plate, two towards a top edge and two towards a bottom edge, four anchoring elements, four nuts and four washers. Four holes are drilled at a predetermined distance into a wall surface based on a distance between the four slots on the back plate of the stability grab bar. The back plate is aligned to the drilled holes such that an anchoring element can easily screw the backplate to the wall surface and into each of the previously drilled holes. Further, the nuts and washers are utilized on each of the four anchoring elements to secure and tighten the grab bar assembly to the wall. The slots of the grab bar of the present invention provide for a slidable handle assembly, which is easily accessible by the user depending on the position of the user in the shower or tub or the size of the user. The slots allow the user to change the position of the stability bar independent of the drilled holes as the bar along with the back-plate slides securely and moves easily. The invention also offers from a more convenient and hassle-free installation of the grab bars for the user with no need for a precise drill placement.

The safety grab bar assembly of the present invention is easily installable and is designed to provide stability to a user while using a shower, spa or bathtub or accessing bathrooms. The grab bar assembly can be fixed by utilizing anchoring screws over a plurality of defined slot spaces on a back plate, thereby enabling the grab bar to slide. The easy installation of the grab bar saves time and is a hassle-free method to attach the grab bar on the wall surface of the shower or tub enclosure. The grab bar assembly of the present invention is available in a variety of colors, sizes, textures and styles to provide maximum customer satisfaction and safety. By using grab bars of different styles or colors, the grab bar can match a bathroom décor and be inconspicuous to others.

In one exemplary embodiment of the presently described invention, a safety bar for use in a bathroom, has a backplate with first and second edges and top and bottom edges, two slots disposed along each of the top and bottom edges running generally parallel to the top and bottom edges. Each of the slots has a length equal to at least twenty percent of the edges. A plurality of anchoring elements with at least one anchoring element for each of the slots along each of the top and bottom edges, and each of the plurality of anchoring elements has a width approximately equal to the width of the slots. A grab bar is secured to the backing plate and spaced inwardly from each of the first and second edges and top and bottom edges. The grab bar also preferably has a gripping surface for secure handling.

In a further exemplary embodiment of the presently described invention, a bathtub safety stall installation is described and includes a bathtub enclosure that has a tub, a faucet and at least one wall adjacent the bathtub. A backplate is provided which has first and second edges and top and bottom edges, two slots disposed along each of the top and bottom edges and running generally parallel to the top and bottom edges, wherein each of the slots has a length equal to at least twenty percent of the length of the top edge. The backplate is secured to the at least one wall by a plurality of anchoring elements with at least one anchoring element for each of the slots along each of the top and bottom edges, wherein each of the plurality of anchoring elements has a width approximately equal to a width of the slots. A grab bar is secured to the backing plate and spaced inwardly from each of the first and second edges and the top and bottom edges, wherein the grab bar has a gripping surface and further wherein the grab bar and the associated backplate are constructed to hold up to 500 pounds of load.

In a still further exemplary embodiment, a method of using a safety grab bar is described and provides the steps of initially providing one of a bathtub, shower or spa. Next, installing a safety grab bar, the safety grab bar having a backplate with first and second edges and top and bottom edges, two slots disposed along each of the top and bottom edges and running generally parallel to the top and bottom edges, wherein each of the slots has a length equal to at least twenty percent of the length of the top edge. The backplate is secured to a wall by a plurality of anchoring elements with at least one anchoring element for each of the slots along each of the top and bottom edges, wherein each of the plurality of anchoring elements has a width approximately equal to a width of the slots. A grab bar is secured to the backing plate and spaced inwardly from each of the first and second edges and top and bottom edges, wherein the grab bar has a gripping surface and further wherein the grab bar and backplate are constructed to hold up to 500 pounds of load. The individual then enters the one of the bathtub, the shower or the spa and grips the safety bar grab. The user can also slidably adjust the position of the safety grab bar to suit the user's need and/or preference.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
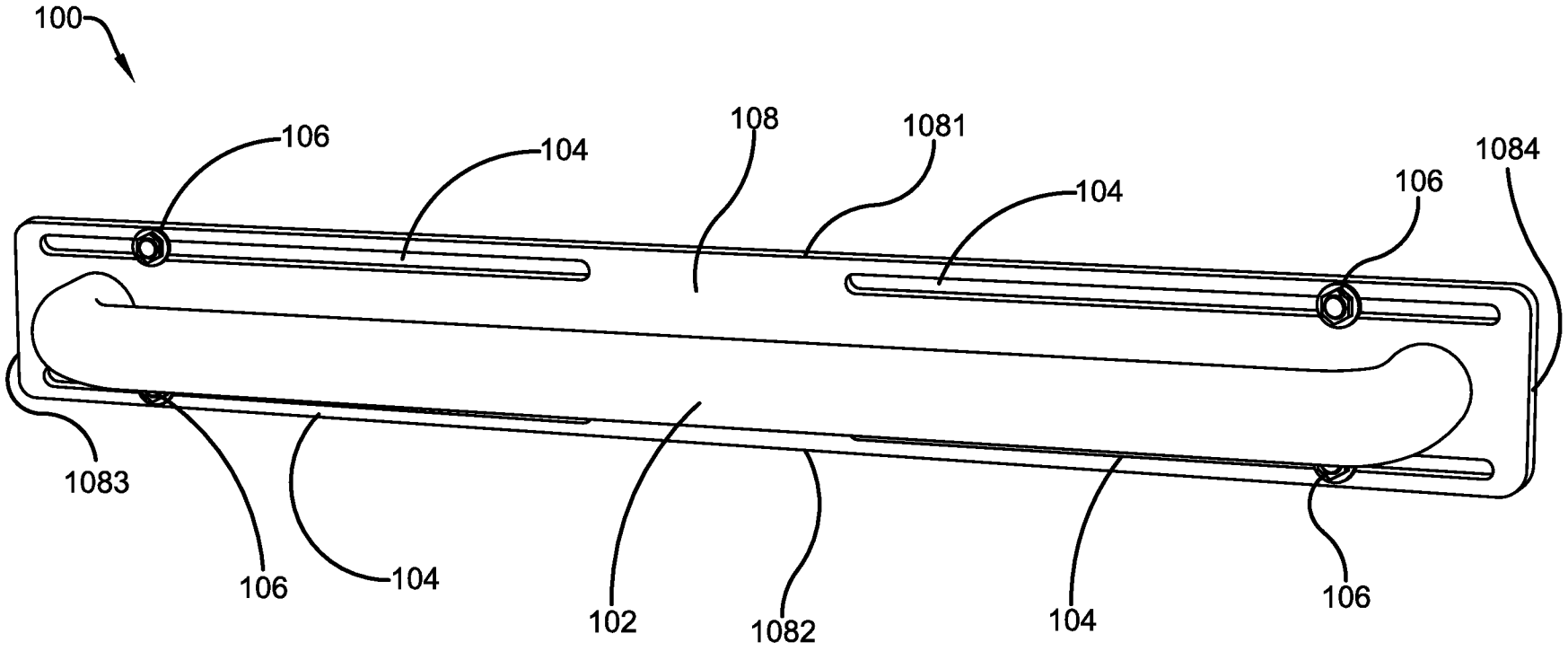
FIG. 1 illustrates a perspective view of one possible embodiment of a grab bar assembly of the present invention in accordance with the disclosed structure.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

As noted above, there exists a long felt need in the art to provide users with a safety grip bar assembly that can be utilized by individuals using, cleaning or servicing showers, spas, therapeutic tubs or bathtubs. There is a long felt need in the art for a grab bar or a handle assembly that is easily installable and useable. There is a long felt need in the art for a grab bar assembly which saves installation time and is hassle-free to set up and use. There is also a long felt need in the art to provide a grab bar assembly which can be installed without an external expert support. Additionally, there is a long felt need in the art for a grab bar assembly which is inexpensive yet effective in providing support and safety to the users. Finally, there is a long felt need in the art for a grab bar which can be installed without the requirement for precise screw placement.

The innovative product of the present invention features a grab bar assembly that provides stability to users while using showers, spas, bathtubs and the like. The stability grab bar product has an anti-slip knurled grab bar, a slotted back plate of the bar, with two longitudinally extending slots adjacent the top edge of the back plate and two longitudinally extending slots adjacent the bottom edge of the back plate, with each set of longitudinally extending slots being parallel with one another and having a similar size. The assembly further includes a plurality of wall anchoring elements, nuts and washers. To install the stability grab bar on a wall surface, a user pre-drills holes in a wall surface based on a slot distance and slot structure on the back plate of the bar. The user places the stability bar horizontally over the drilled holes, such that the slots in the stability bar back plate align with the drilled holes. The user then fixes the bar by inserting the anchoring elements into the drilled holes, and secures the bar assembly by using nuts and washers and tightening the screws.

The uniquely designed safety grab bar assembly enables sliding of the grab bar in a longitudinal direction corresponding to the direction of the slots, and provides easy access for the user in showers, bathtubs, spas, bathrooms, etc. The slidable feature enables a user to adjust the handle bar position as per their own requirements. Further, the grab bar assembly has a structure that provides stability and safety to a user while entering or exiting from a shower, a spa or a bathtub. The grab bar assembly is easily installed without any expert support and/or any precise screw placement requirement, thereby saving the user time. The stability bar assembly of the present invention is available in variety of colors, sizes, textures and styles to provide maximum customer satisfaction.

Referring initially to the drawings, FIG. 1 illustrates a perspective view of one possible embodiment of a safety grab bar assembly of the present invention in accordance with the disclosed structure. The grab bar assembly 100 comprises a stability bar 102, four symmetrical slots 104 disposed parallel to the direction of the grab bar 100, at least four anchoring elements 106, and a back plate 108.

In a preferred embodiment, four holes are pre-drilled at predetermined positions as per the position of slots 104 on the back plate 108. The holes should be drilled at approximately the same position within each of the slots. For example, when the back plate is positioned on the wall and held temporarily to the wall such as with tape, the user could drill each of the holes at the front of the slots so that the bar has the remaining length of the slot to slide. The holes could also be drilled centrally to the slots so that the bar could move in either direction, left or right. Alternatively, if the user decides to place the bar along the "Y" axis or perpendicular to the ground, or diagonally, the same logic of placement of the screws would apply.

The back plate or base 108 is preferably a substantially rectangular, metal-based plate with curved corners. The back plate 108 comprises a top edge 1081 and a bottom edge 1082, the top edge 1081 and the bottom edge 1082 are mirror images of each other. The back plate 108 comprises a right edge 1083 and a left edge 1084, the right edge 1083 and the left edge 1084 are mirror images of each other. The back plate further comprises open slots 104, two each along the top edge 1081 and bottom edge 1082 and is placed horizontally over a wall surface such that each slot 104 aligns with each of the four drilled holes. The length of the back plate 108 may range from 12 inches to 36 inches and the height may range from 6 inches to 9 inches. The individual slots 104 are horizontal openings in the back plate 108, with two slots cut-out therefrom approximately ½ inches below the top edge 1081 of the back plate 108 on either side of the middle longitudinal axis of the back plate 108 and two slots cut-out approximately ½ inches above from the bottom edge 1082 of the back plate 108 on either side of the middle longitudinal axis of the back plate 108. The length of each individual slot 104 may range from 20% to 40% of the length of the back plate 108. Once the slots overlap the pre-drilled holes, each of the four anchoring elements 106 are inserted into the drilled holes and are securely tightened to fix the bar assembly 100. The height of the slots 104 is substantially the same as the diameter of the anchoring element screw 106 such that a top end and bottom end of each slot 104 touches the screw 106. The grab bar or handle 102 is pipe-shaped or a solid rod shaped structure, and is an anti-slip knurled grab bar 102. More specifically, knurling may be used to create a pattern or gripping surface on a cylindrical blank and can be used on a variety of metals such as steel, brass, aluminum alloys and even hard plastics. Knurls typically have V-shaped teeth that deform, displace or push the material rather than cut it. The most common knurled patterns are diagonal, diamond and straight. Decorative patterns can also be generated. There are two methods of specifying the comparative tooth spacing in knurled patterns, namely a circular pitch and a diametrical pitch. The circular pitch system has been used for many years and is based on the distance between teeth (pitch) and expressed as teeth per inch of circumference or TPI. The diametrical pitch system is explained in American Standard ANSI/ASME B94.6-1984, and only four standard pitches are typically used, namely 64, 96, 128, & 160, for blank diameters from 3/32" to 2".

The grab bar 102 has a thickness and strength that can support the body of an individual when the individual grips, leans on, or otherwise uses the grab bar 102 for support. As per the present disclosure, a diameter of the handle 102 may range from 1 to 2 inches in width, and the length of the handle may range from 12 inches to 36 inches. Further, the space allowance between the handle 102 and the back plate 108 may range from 1 inch to 1 inches to comfortably accommodate a user's hand. The handle 102 and the back plate 108 can be made of stainless steel, chrome plated steel, nylon-coated mild steel, chromed brass, epoxy-coated aluminum, ABS plastic, and even vinyl-coated metal or other similar materials, which are sufficient to enable knurling of the surface. Alternatively, a grab surface maybe adhesive applied over the bar either as a cover when the original knurling is worn down, or initially to provide a different type of grab surface. The grab bar assembly 100 may be compliant with Americans with Disabilities Act (ADA) standards. Further, the applications of the grab bar assembly are not limited and can be utilized by users in bathrooms, washrooms, showers, bathtubs, and the like.

Figure 2A:
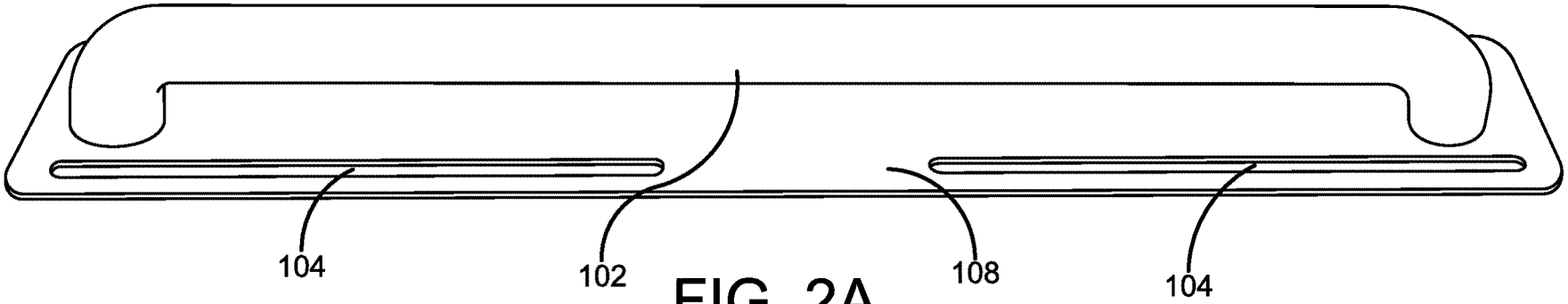
FIG. 2A illustrates a perspective view of one possible embodiment of a grab bar assembly of the present invention in accordance with the disclosed structure.
Figure 2B:
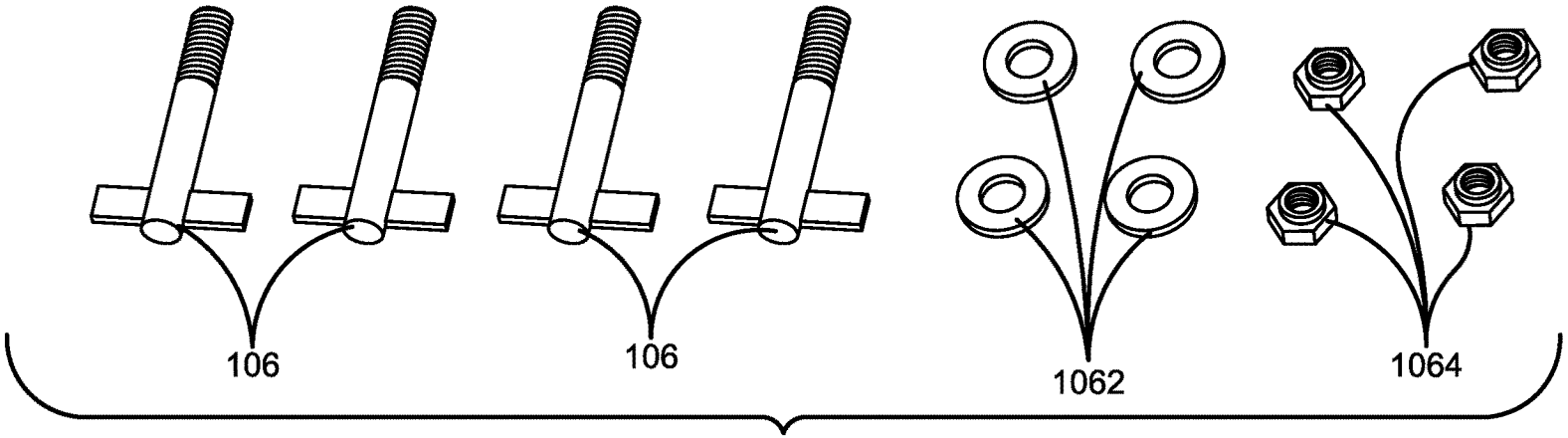
FIG. 2B illustrates a perspective view of one possible embodiment of the hardware associated with the grab bar assembly of the present invention in accordance with the disclosed structure.

FIGS. 2A and 2B collectively illustrates an exploded view of one possible embodiment of a grab bar assembly of the present invention in accordance with the disclosed structure. More specifically, FIG. 2A discloses a handle 102 attached to a frame 108, such as by welding or additional fasteners. The back plate 108 preferably comprises four slots 104, with two slots 104 above the handle position and two slots 104 below the handle position. FIG. 2B discloses grab bar securing elements, preferably comprising four anchoring elements 106, four nuts 1064 and four washers 1062.

In a most preferred embodiment, the grab bar 100 is made up of metal with appropriate strength, rigidity and durability, preferably stainless steel, chrome plated steel, chromed brass, nylon-coated mild steel, epoxy-coated aluminum, ABS plastic, and even vinyl-coated metal or other similar materials. However, a variety of other materials may also be used to manufacture the grab bar 102 of the present invention. Metal also provides smooth surfaces that may be conveniently cleaned and easily sterilized. The anchoring elements 106, nuts 1064 and washers 1062 are preferably also formed of metal for strength and durability to handle the weight of the user, and are preferably made according to ADA standards for maximum strength and durability. In a preferred embodiment, the grab bar 100 is capable of supporting 500 lbs. of weight. The grab bar assembly 100 may be made available in variety of colors, sizes, shapes and styles to suit user need and/or preference. The grab bar 102 and backing plate 108 may also be provided with an anti-microbial coating to reduce surface contamination.

Figure 3:
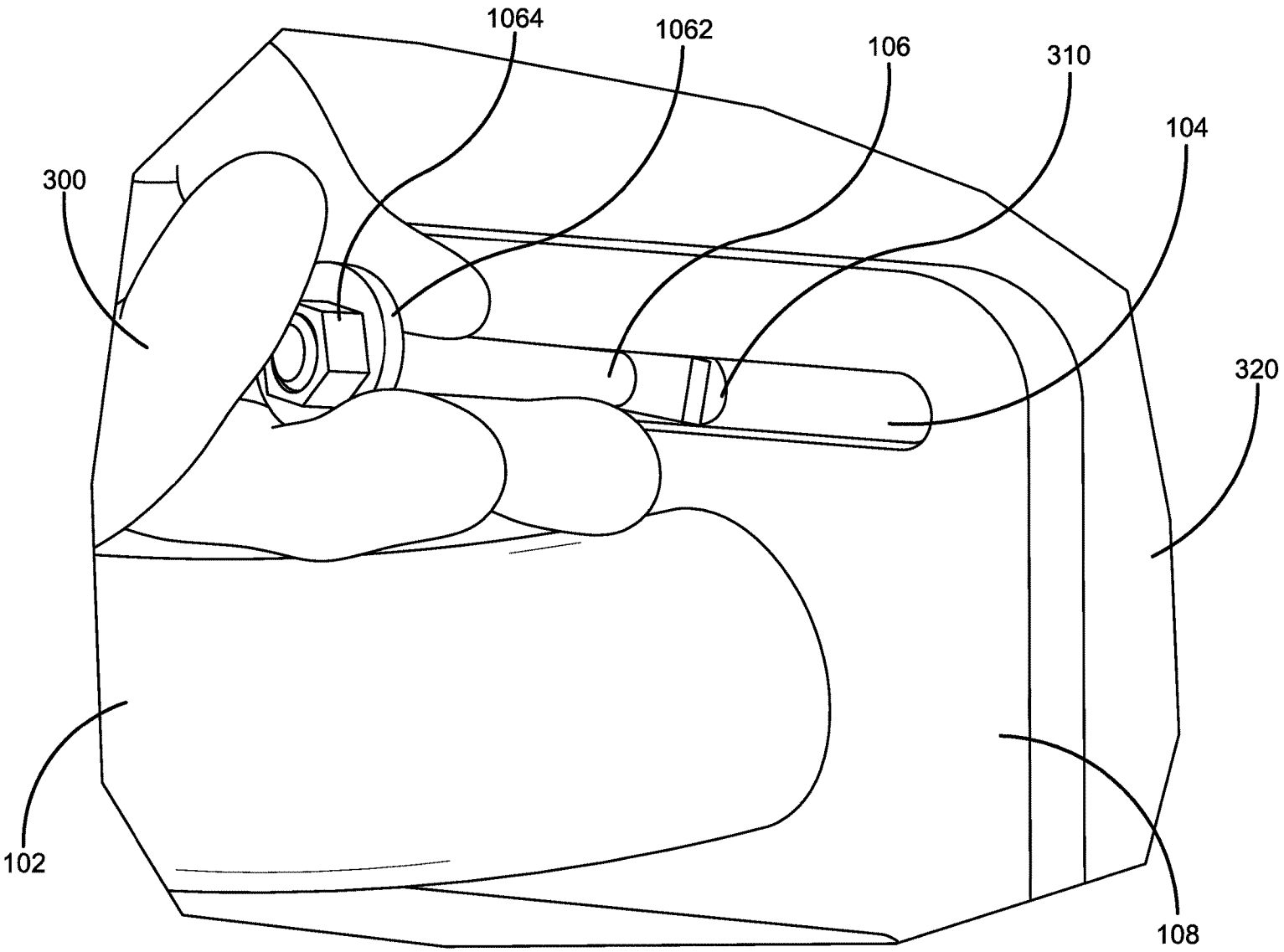
FIG. 3 illustrates a perspective view of one possible embodiment showing installation of the grab bar of the present invention in accordance with the disclosed structure.

FIG. 3 illustrates a perspective view of one possible embodiment showing installation of the grab bar of the present invention in accordance with the disclosed structure. The grab bar assembly 100 of the present invention provides a plurality of anchoring elements 106 to easily install the grab bar 102 on the wall of an enclosure for a tub, shower or spa without the need for external help. More specifically, in order to mount the grab bar assembly 100 on a wall surface 320, four holes 310, one for each slot, are drilled through the wall 320 in laterally spaced apart relation corresponding to a distance between the open slots 104 on the back plate 108. A user 300 can place the back plate 108 with the grab bar 102 on the wall surface 320 such that the holes 310 align with the open slots 104 present in the grab bar frame 108. The back plate can be temporarily held in position by tape or other removable adhesive to allow for drilling of the holes. The grab bar assembly 100 is anchored to the wall using anchoring elements 106 which are inserted into each of the holes 310 through the slots 104. Further, the washers 1062 and the nuts 1064 are placed over the anchoring elements 106 to secure and tighten the grab bar assembly 100 to the wall. Further, the presence of slots 104 enables sliding or moving of the handle 102 horizontally relative to the wall.

Figure 4:
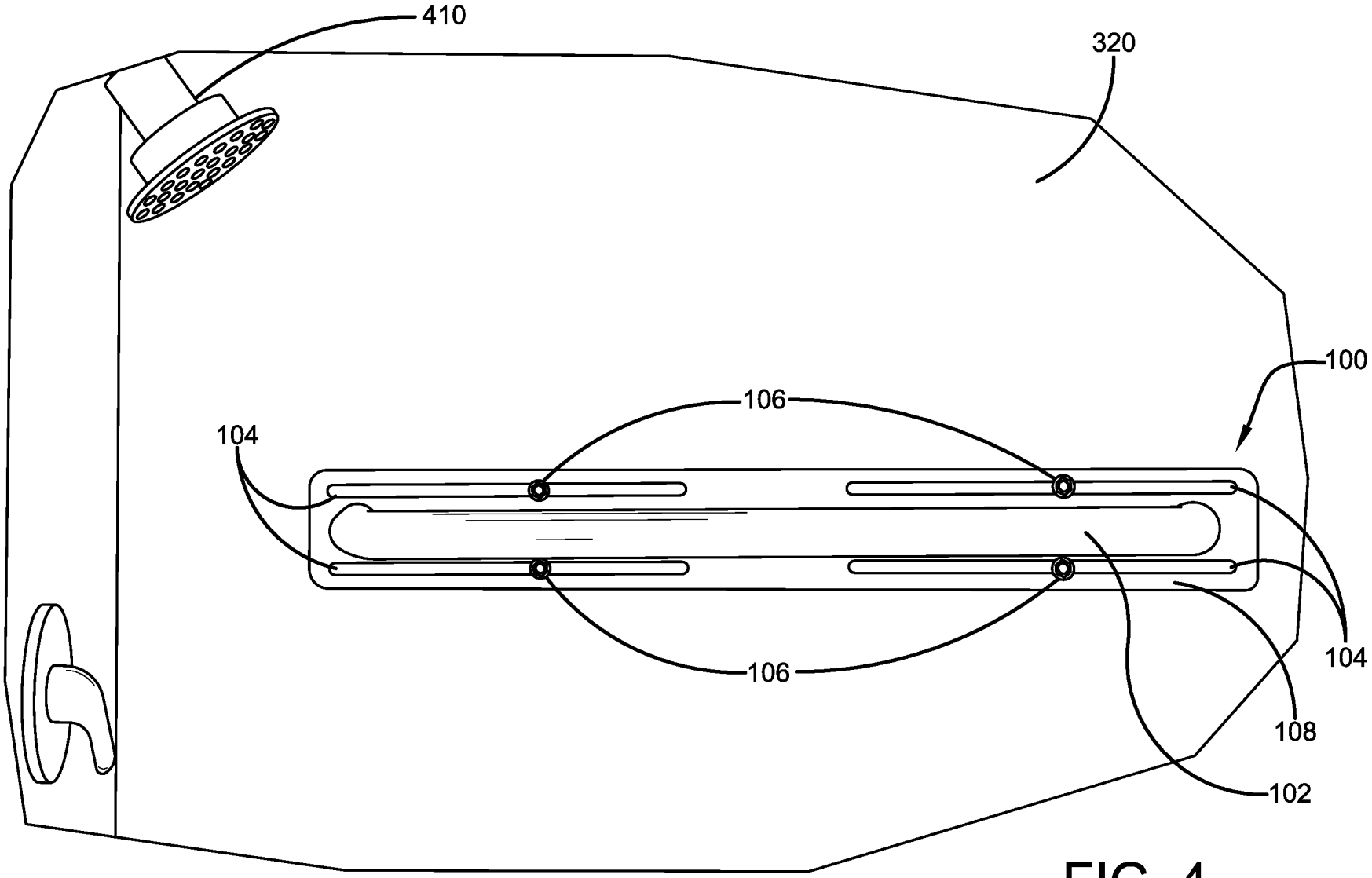
FIG. 4 illustrates a perspective view of one possible embodiment showing shower installation having an installed grab bar of the present invention in accordance with the disclosed structure.

FIG. 4 illustrates a perspective view of an installation for a shower stall and having a horizontally installed grab bar assembly of the present invention in accordance with the disclosed structure. It should be understood that the grab bar assembly may also be installed perpendicularly to the floor, or at a diagonal, depending on the wants and needs of the user. In addition, more than one grab bar assembly may be installed to the wall, for example, with a first unit being installed horizontally to the floor, and a second unit being installed at one of a perpendicular or diagonal configuration to the first bar installation.

A user 300 can easily grab the grab bar handle 102 to obtain support while taking a shower 410 or entering or exiting the shower stall. Users who are old and weak can get stable support from the grab bar handle 102 installed on the wall near the shower 320, and accidental slips and falls can be prevented. Also, the back plate 108, along with the handle 102, is slidable relative to the wall on the anchored elements 106. Accordingly, the user 300 may slide the handle 102 towards, for example, the shower head 410, away from the shower head 410, or leave the anchoring elements fixed 106 at the predetermined drilled positions such that the complete grab bar assembly 100 remains stable. In addition, the user may position the grab bar handle 102 so that the user does not have to stand directly in the flow of the shower water and so that the use can adjust his or her positioning at any time during the bathing or showering process.

Figure 5:
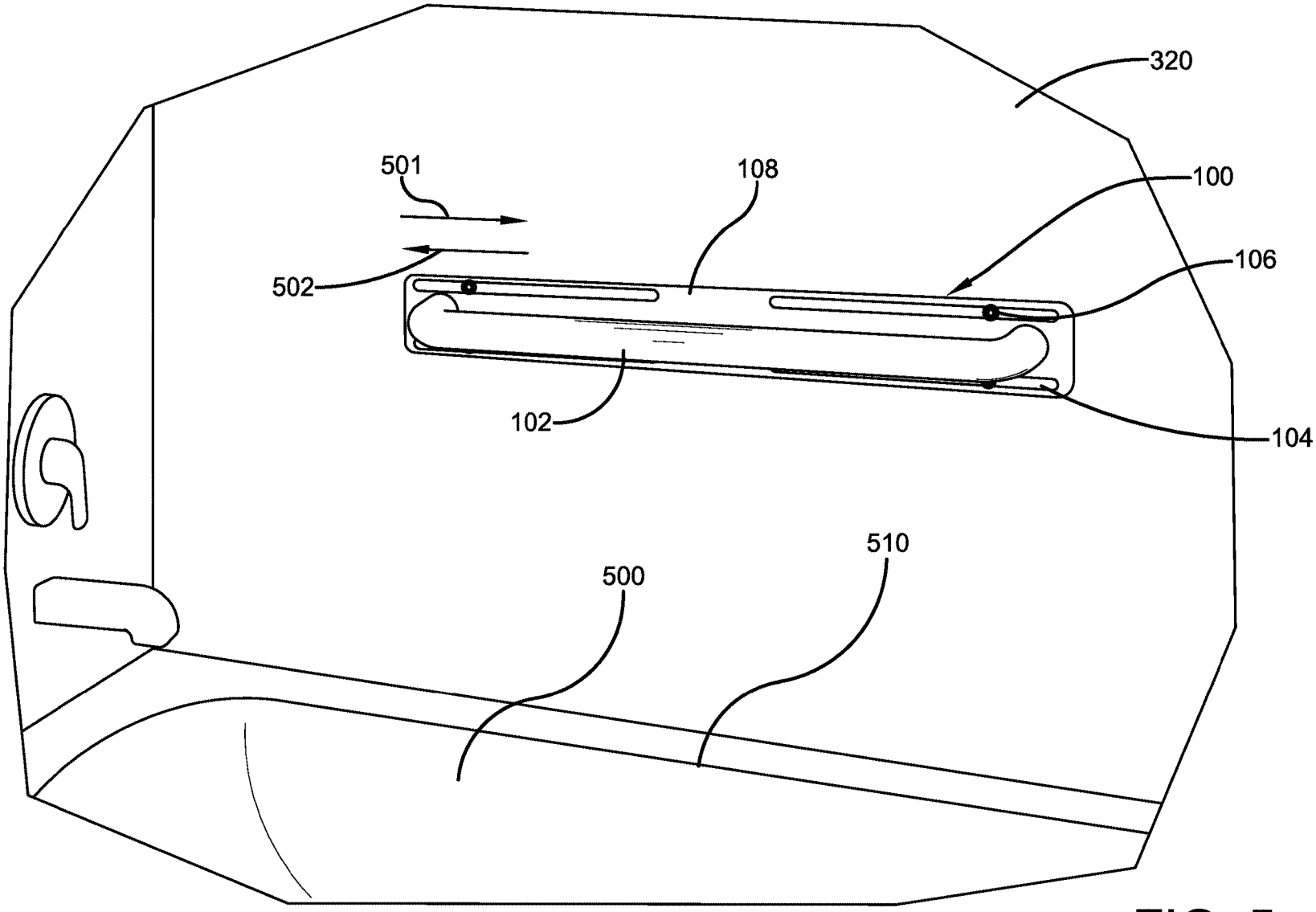
FIG. 5 illustrates a perspective view of one possible embodiment showing tub installation having a horizontally installed grab bar of the present invention in accordance with the disclosed structure.

FIG. 5 illustrates a perspective view of a tub installation having a horizontally installed grab bar of the present invention in accordance with the disclosed structure with the handle running generally parallel to the bottom surface of the tub. The easy to install grab bar assembly 100 may be installed on a wall 320 above a tub rim 510 of a bathtub 500 at an appropriate height as desired by a user to provide support to the user while entering or exiting the bathtub 500 or while standing or sitting within bathtub 500.

More specifically, the anchoring elements 106 are pre-drilled into the wall 320, and the grab bar is secured onto the wall 320 using the slots 104 and the anchoring elements. The individual slots 104 rest on the corresponding anchoring element screw 106 once inserted into the pre-drilled holes and the height of the individual slot 104 is substantially the same as the diameter of the anchoring element screw 106 such that a top end and bottom end of each slot 104 touches the screw 106, thereby avoiding the vertical shifting of the back plate during use. Additionally, the user may slide the grab bar assembly 100 longitudinally by moving the handle 102 in the longitudinal direction 501 as desired and the fixed anchoring elements 106 will be repositioned with the slots 104. Once the desired position is achieved, the user will no longer apply longitudinal force to the handle 102 and the screws 106 may be further tightened. Accordingly, it will be appreciated that the grab bar assembly 100 may be repositioned a distance that is equal to or less than the length of the slots 104, thereby providing extended coverage of the space along the wall 320 due to the sliding backplate 108 as desired by the user.

Figure 6:
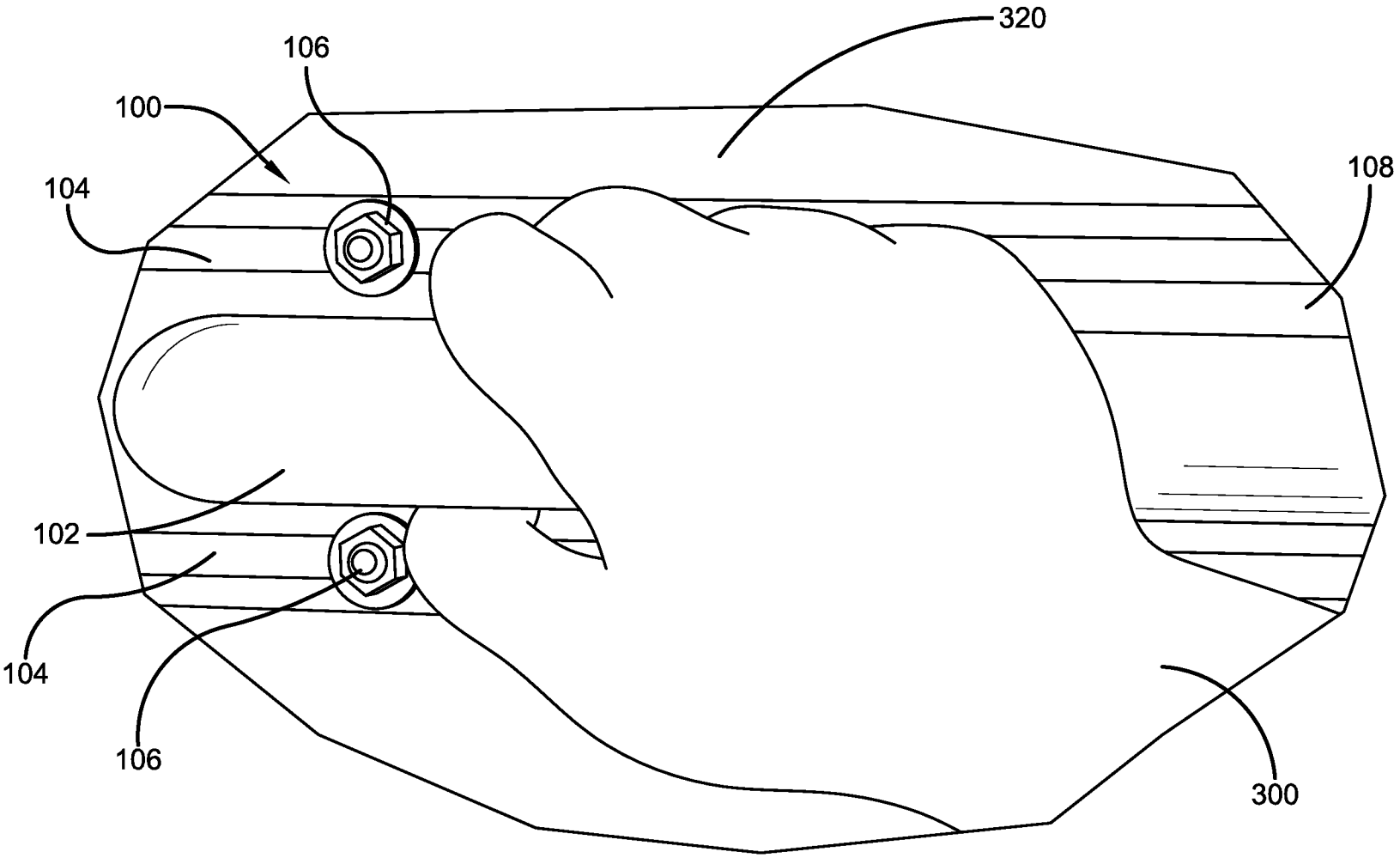
FIG. 6 illustrates a perspective view of one possible embodiment showing how a user can obtain support from the grab bar of the present invention in accordance with the disclosed structure.

FIG. 6 illustrates a perspective view of one possible embodiment of how a user can obtain support from the grab bar assembly 100 of the present invention and in accordance with the disclosed structure. As stated above, the easy to install grab bar assembly 100 can be installed on a wall 320 near a shower 410 or a bathtub 500 to provide a support to a user 300. The grab bar assembly 100 of the present invention can be of any color and design that can aesthetically integrate with the surrounding showering or bathing area so as to render the grab bar assembly 100 relatively inconspicuous. The grab bar assembly 100 provides a gripping support for users, thereby preventing serious accidents and injuries from occurring.

The present invention provides a unique solution to the problem of providing support and safety while using a shower 410 and/or a bathtub 500 or spa. The grab bar assembly 100 protects the user 300 while, for example, taking a bath or shower, entering or exiting the bathtub 500, or while moving from a standing or sitting position (or vice versa) during the bathing process. Moreover, the easy to install grab bar assembly 100 of the present invention requires fewer tools and little skill for installation. Further, the grab bar assembly 100 is quickly installed without precise placement of the anchoring element, and therefore saves the user time and creates a larger coverage of support than traditional fixed grab bars due to the sliding capability of the slots positioned on the back plate.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "grab bar", "grip bar", "grab handle", "grip handle", "stability bar" and "hand grab bar" are interchangeable and refer to a grab bar 102 which is held by a user to get a support while accessing shower or bathtub. The terms "back plate", "base", "frame" and "back frame" also hold the same meaning as of 108 and can be used replaceable for each other.

Notwithstanding the forgoing, the grab bar assembly 100 of the present invention and its various structural components can be any suitable size, color, style and configuration as is known in the art without affecting the overall concept of the invention, provided that it accomplishes the above stated objectives. One of ordinary skill in the art will appreciate that the style and size of the grab bar assembly 100 and its various components, as shown in the FIGS. are for illustrative purposes only, and that many other styles and sizes of the grab bar assembly 100 are well within the scope of the present disclosure. Although the dimensions of the grab bar assembly 100 and its components (i.e., length, width, and height) are important design parameters for good performance, the grab bar assembly 100 and its components may be any size, color and style that ensures optimal performance during use and/or that suits user need and/or preference.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A safety bar comprising:

a backplate having first and second edges and top and bottom edges, two slots disposed along each of the top and bottom edges and running generally parallel to the top and bottom edges, each of the two slots having a length equal to at least twenty percent of a length of the top and bottom edges;

a plurality of anchoring elements with at least one anchoring element for each of the two slots, wherein each of the plurality of anchoring elements has a width approximately equal to a width of each of the two slots; and a grab bar secured to the backplate and spaced inwardly from each of the first and second edges and the top and bottom edges, wherein the grab bar is comprised of a gripping surface; and wherein the back plate and the grab bar are slidable relative to the wall on the plurality of anchoring elements when in use.

2. The safety bar of claim 1, wherein the gripping surface is comprised of a knurling.

3. The safety bar of claim 2, wherein the knurling has a pattern selected from a diagonal pattern, a diamond pattern, and a straight pattern.

4. The safety bar of claim 3, wherein the knurling is performed in accordance with American Standard ANSI/ASME B94.6-1984.

5. The safety bar of claim 2, wherein the knurling is formed by a tool having V shaped teeth.

6. The safety bar of claim 2, wherein the knurling provides a decorative pattern.

7. The safety bar of claim 1, wherein each of the anchoring elements is comprised of a nut and a washer.

8. The safety bar of claim 1, wherein each of the two slots has a width of about ½".

9. The safety bar of claim 1, wherein the backplate has a length ranging from 12 to 36 inches.

10. The safety bar of claim 1, wherein the grab bar has a central portion spaced apart from the backplate by a distance of between 1 to 1.5 inches.

11. The safety bar of claim 1, wherein the safety bar is comprised of an antimicrobial coating.

12. The safety bar of claim 1, wherein the safety bar is installed in one of a horizontal, a perpendicular or a diagonal direction to that of a floor.

13. The safety bar of claim 1, wherein the safety bar is installed in one of a shower, a bathtub, a spa or a therapeutic tub.

14. A bathtub safety stall installation comprising:

a bathtub enclosure having a bathtub, a faucet and at least one wall adjacent the bathtub;

a backplate having first and second edges and top and bottom edges, two slots disposed along each of the top and bottom edges and running generally parallel to the top and bottom edges, each of the two slots having a length equal to at least twenty percent of a length of the top and bottom edges, wherein the backplate is secured to the at least one wall by a plurality of anchoring elements with at least one anchoring element for each of the two slots, each of the plurality of anchoring elements having a width approximately equal to a width of each of the two slots; and a grab bar secured to the backplate and spaced inwardly from each of the first and second edges and the top and bottom edges, wherein the grab bar is comprised of a gripping surface; and wherein the back plate and the grab bar are longitudinally adjustable in position relative to the at least one wall adjacent the bathtub on the plurality of anchoring elements when in use during bathing or showering.

15. The bathtub safety stall installation of claim 14, wherein each of the backplate and the grab bar are provided with an antimicrobial coating and can support up to 500 pounds.

16. The bathtub safety stall installation of claim 14, wherein the grab bar is installed in one of a horizontal, a perpendicular or a diagonal direction to that of a floor of the bathtub enclosure.

17. The bathtub safety stall installation of claim 14, wherein the backplate has a length ranging from 12 to 36 inches, and the grab bar has a central portion spaced apart from the backplate a distance of between 1 to 1.5 inches.

18. The bathtub safety stall installation of claim 14, wherein the gripping surface has a pattern selected from a diagonal pattern, a diamond pattern, and a straight pattern, and the gripping surface is created by knurling.

19. A method of using a safety grab bar comprising the steps of:

providing one of a bathtub, a shower or a spa;

installing a safety grab bar, wherein the safety grab bar is comprised of a backplate having a first edge, a second edge, a top edge, a bottom edge, at least two slots disposed along each of the top and bottom edges and running generally parallel to the top and bottom edges, each of the two slots having a length equal to at least twenty percent of the top or bottom edges, wherein the backplate is secured to a wall by a plurality of anchoring elements with at least one anchoring element for each of the two slots, wherein the at least one anchoring element has a width approximately equal to a width of one of the two slots, and a grab bar secured to the backing plate and spaced inwardly from each of the first and second edges and the top and bottom edges, wherein the grab bar is comprised of a gripping surface;

entering the one of bathtub, shower or spa and gripping the safety grab bar; and sliding the safety grab bar relative to the wall to a position comfortable for a user; and readjusting the safety grab bar relative to the wall to a second position comfortable for the user without adjusting the plurality of anchoring elements.

20. The method of using a safety grab bar of claim 19, wherein the gripping surface has a pattern selected from a diagonal pattern, a diamond pattern, and a straight pattern, wherein the gripping surface is created by knurling, wherein the backplate has a length ranging from 12 to 36 inches, and further wherein the grab bar has a central portion spaced apart from the backplate by a distance of between 1 to 1.5 inches.

* * * * *